United States Patent [19]

Shaw

[11] 4,222,672

[45] Sep. 16, 1980

[54] STATIC MIXER

[75] Inventor: Milton C. Shaw, Tempe, Ariz.

[73] Assignee: University Patents, Inc., Norwalk, Conn.

[21] Appl. No.: 31,451

[22] Filed: Apr. 19, 1979

[51] Int. Cl.[2] ..... B01F 5/06

[52] U.S. Cl. ..... 366/338

[58] Field of Search ..... 366/336, 337, 338, 339, 366/340, 150, 341, 183; 138/38, 42; 261/112

[56] References Cited

U.S. PATENT DOCUMENTS

| | | | |
|---|---|---|---|
| 2,025,974 | 12/1935 | Fritz | 366/11 |
| 3,051,453 | 8/1962 | Sluijters | 366/337 |
| 3,219,483 | 11/1965 | Goos | 366/337 |
| 3,239,197 | 3/1966 | Tollar | 366/337 |
| 3,286,992 | 11/1966 | Armeniades | 366/339 |
| 3,459,407 | 8/1969 | Hazelhurst | 366/338 |
| 3,775,063 | 11/1973 | Grout | 261/112 |
| 3,874,643 | 4/1975 | Lorenian | 366/338 |
| 3,908,702 | 9/1975 | Klosse | 138/42 |
| 4,040,256 | 8/1977 | Bosche | 366/337 |
| 4,043,539 | 8/1977 | Gilmer | 366/340 |

*Primary Examiner*—Robert W. Jenkins
*Attorney, Agent, or Firm*—Martin Novack

[57] ABSTRACT

An improved static mixer is disclosed which is capable of efficient mixing and is of a construction which allows relatively inexpensive manufacture. A pair of flow channels are provided for respectively receiving the fluids to be mixed at respective ends thereof. The flow channels have at least one common wall element therebetween, the common wall element having an undulating shape which alternately enlarges and restricts one of the channels while simultaneously alternately restricting and enlarging the other of the channels in opposing relationship. The common wall has openings therein at about the peaks and valleys of the undulations. In operation, two fluids to be mixed are introduced to the respective flow channels. At each peak or valley of the undulating wall element, the opposing enlargement and restriction of the two channels causes a pressure difference and results in a cross flow through the openings in the common wall element. In one form of the disclosed mixer, the common wall element comprises an undulating sheet separating side-by-side flow channels. In another form of the disclosed mixer, the common wall element comprises an undulating annulus separating concentric flow channels.

38 Claims, 8 Drawing Figures

STATIC MIXER

BACKGROUND OF THE INVENTION

This invention relates to the mixing of fluids and, more particularly, to a motionless mixer apparatus which operates on a multiple venturi principle.

In industrial mixing two or more materials are blended together to yield a homogeneous product. Devices that employ propellers or turbines to cause mixing by agitation are quite common. These "dynamic" type mixers, while quite effective, involve the use of power driven elements and other moving parts which tend to make them relatively expensive to manufacture, install, operate and maintain. Motionless or "static" mixers are advantageous in that they have no moving parts, but mixing action is not always adequate. The simplest device of the static type is a straight length of pipe 50 to 100 diameters in length. Various more complicated static mixers are described, for example, in U.S. Pat. Nos. 2,025,974, 2,784,530, 3,051,453, 3,239,197, 3,286,992, 3,459,407, 3,775,063, 3,908,702, 4,040,256, and 4,043,539.

In one well known type of mixer (see e.g. U.S. Pat. No. 3,286,992) a series of short helical divider elements are mounted in a pipe. Each helical element divides the fluid stream into two parts and causes it to rotate through 180° before it is passed to the next element whose leading edge is oriented at 90° with respect to the final edge of the prior helical element. For n elements there are $2^n$ divisions and recombinations of fluid which is somewhat analagous to cutting a deck of cards $2^n$ times. While this and certain other static mixers are capable of acceptable performance, the nature of the structures involved often does not lend itself well to inexpensive manufacture.

It is an object of the present invention to provide a static mixer which both exhibits good performance and can be fabricated relatively inexpensively from a minimum of parts.

SUMMARY OF THE INVENTION

The present invention is directed to an improved static mixer which is capable of efficient mixing and is of a construction which allows relatively inexpensive manufacture. A first elongated enclosure is provided, this first enclosure defining a first flow channel. A second elongated enclosure is provided adjacent to the first enclosure and has a wall element in common therewith. This second enclosure has an undulating cross-section that defines a second flow channel which is an undulating flow channel. Preferably, although not necessarily, the first enclosure also has an undulating cross-section such that the first flow channel undulates in alternating relationship to the undulations of the second flow channel. This means that the first row channel alternately enlarges and restricts in opposing relationship to the restriction and enlargement, respectively, in the adjacent second flow channel. The common wall element has openings therein at about longitudinal positions thereof corresponding to the peaks and valleys of the undulations of the first and second flow channels.

In operation, two fluids to be mixed are introduced to the respective flow channels. At positions corresponding to each peak or valley of the undulations, the opposing enlargement and restriction of the two channels causes a pressure difference and results in a cross-flow through the openings in the common wall element. This cross-flow is due to the venturi effect and is perpendicular to the main flow in each channel. This produces turbulence and good mixing between stages of the mixer. The number of stages (i.e., the number of waves in the undulating structure) will depend upon the degree of mixing desired.

In one form of the invention, the common wall element comprises an undulating sheet separating side-by-side channels. In another form of the invention, the common wall element comprises an undulating annulus separating concentric flow channels. In the latter form of the invention, inner and outer substantially concentric spaced pipes are provided. A central pipe, in the form of an undulating annulus, is mounted between the inner and outer pipes and in spaced concentric relation thereto. The central pipe has openings therein at about the peaks and valleys of its undulations. An outer flow channel is defined by the region between the central and outer pipes, and an inner flow channel is defined by the region between the central and inner pipes. In still further forms of the invention, the undulations of the first and/or second enclosures are defined by one or more wall elements of the enclosures other than the common wall element.

In the preferred embodiment of the invention, the openings comprise multiple perforations at each of the peaks and valleys of the common wall element. The size and number of perforations at each peak and valley are selected in accordance with the expected pressure differential at the peak or valley.

Further features and advantages of the invention will become more readily apparent from the following detailed description when taken in conjunction with the accompanying drawings.

DESCRIPTION OF THE PREFERRED EMBODIMENT

Figure 1:
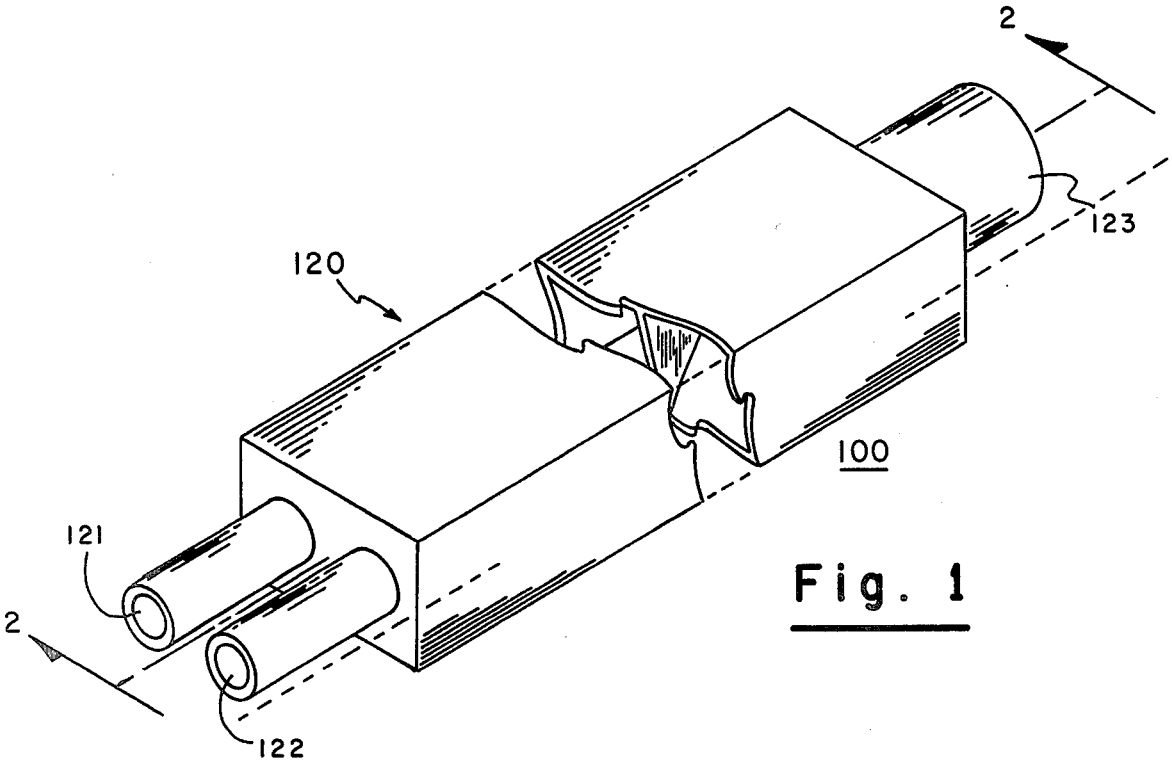
FIG. 1 is an elevational perspective view of a static mixer in accordance with an embodiment of the invention.
Figure 2:
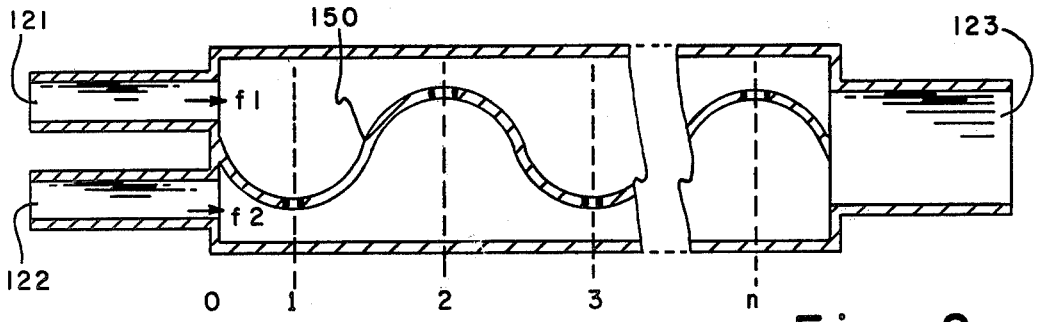
FIG. 2 is a cross-sectional view, taken through a section defined by arrows 2—2 of FIG. 1.

Referring to FIGS. 1 and 2, there is shown an embodiment of a motionless mixer 100 in accordance with an embodiment of the invention. An elongated enclosure 120 is divided into flow channels designated f1 and f2 by a common wall element 150 (FIGS. 2 and 3) which is secured to the top and bottom of enclosure 120 by any suitable fluid-tight means (not shown). A pair of inlet pipes 121 and 122 communicate with channels f1 and f2, respectively, at an inlet end of enclosure 120. An outlet pipe 123 communicates with both flow channels at an outlet end of enclosure 120. The enclosure 120, wall element 150, and inlet and outlet pipes may be formed of any suitable material such as metal or plastic.

Figure 3:
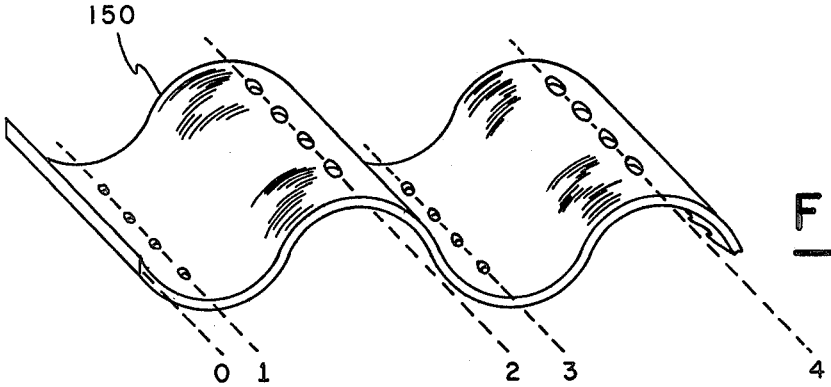
FIG. 3 shows the common wall element of the FIG. 1 embodiment.

The common wall element 150, shown in further detail in FIG. 3, is seen to have an undulating shape, and in the present embodiment it is an undulating sheet of uniform thickness. The wall element 150 is seen to alternately enlarge and then restrict the flow channel f1 while simultaneously alternately restricting and enlarging the flow channel f2. For ease of explanation, the beginning of the wall element 150, which starts equidistant from the side walls of enclosure 120 in this embodiment, is designated "station 0" and then successive valleys and peaks are designated as "station 1", "station 2" etc. A plurality of perforations are located at about each peak and valley of the wall element 150; i.e., at the stations 1, 2, 3 . . . n thereof. The perforations in this embodiment are in a row that is normal to the direction of fluid flow.

In operation, two fluids to be mixed, designated A and B, are introduced to channels f1 and f2, respectively, via inlet pipes 121 and 122. As the fluid A approaches station 1, its velocity decreases and its pressure increases. Just the reverse happens to fluid B as it approaches station 1. The resulting pressure difference causes fluid to flow from channel f1 to channel f2 through the perforations at station 1. As the fluid flows from station 1 to station 2, the pressure difference developed is in the opposite direction and causes fluid to flow from f2 to f1 through the perforations at station 2. Thus, each time a peak or valley (i.e., a mixing stage) of the undulating common wall element 150 is encountered, fluid flows transversely to the axis of mixer 100. Since the cross flow is at right angles to the main flow in each channel, this produces turbulence and good mixing between stages. The number of stages required will depend upon the degree of mixing desired.

The operation of mixer 100 can be better understood with reference to an example. Consider two pure liquids A and B entering the mixer with 100 parts by volume of A entering f1 and 100 parts by volume of B entering f2. Assume that the perforations of stations, 1, 2 . . . n, are sufficient in size and number to allow 25% cross flow at each station with the pertaining pressure difference. Table I shows the number of particles of A and B to be expected at each station for channels f1 and f2. The last column of Table I shows the difference between A and B in channel f2 at each station. It is clear from this table that to insure perfect mixing, an infinite number of stations would be required.

TABLE I

| | Channel f1 | | | Channel f2 | | | |
|---|---|---|---|---|---|---|---|
| Station No. | A | B | Σ | A | B | Σ | \|A-B\| |
| 0 | 100 | 0 | 100 | 0 | 100 | 100 | 100 |
| 1 | 75 | 0 | 75 | 25 | 100 | 125 | 75 |
| 2 | 81.25 | 25 | 106.25 | 18.75 | 75 | 93.75 | 56 |
| 3 | 60.94 | 18.75 | 79.69 | 39.06 | 81.25 | 120.31 | 42 |
| 4 | 70.71 | 39.06 | 109.77 | 29.30 | 60.94 | 90.24 | 32 |
| 5 | 53.03 | 29.30 | 82.33 | 46.98 | 70.71 | 117.69 | 24 |
| 6 | 64.78 | 46.98 | 111.76 | 35.24 | 53.03 | 88.27 | 18 |
| 7 | 48.59 | 35.24 | 83.83 | 51.44 | 64.78 | 116.22 | 13 |
| 8 | 61.45 | 51.44 | 112.89 | 38.58 | 48.58 | 87.16 | 10 |
| 9 | 46.09 | 38.58 | 84.67 | 53.94 | 61.44 | 115.38 | 7.5 |
| 10 | 59.58 | 53.94 | 113.52 | 40.46 | 46.09 | 86.55 | 5.6 |
| 11 | 44.69 | 40.46 | 85.15 | 55.36 | 59.58 | 114.04 | 4.2 |
| 12 | 58.53 | 55.36 | 113.89 | 41.52 | 44.69 | 86.21 | 3.2 |
| 13 | 43.90 | 41.52 | 85.42 | 56.15 | 58.53 | 114.68 | 2.4 |
| 14 | 57.94 | 56.15 | 114.09 | 42.11 | 43.90 | 86.01 | 1.8 |
| 15 | 43.46 | 42.11 | 85.57 | 56.60 | 57.94 | 114.54 | 1.3 |
| 16 | 57.61 | 56.60 | 114.21 | 42.45 | 43.46 | 84.91 | 1.0 |
| 17 | 43.21 | 42.45 | 85.66 | 56.85 | 57.61 | 114.46 | 0.7 |
| 18 | 57.42 | 56.85 | 114.27 | 42.64 | 43.21 | 85.85 | 0.5 |
| 19 | 43.07 | 42.64 | 85.71 | 57.00 | 57.42 | 114.42 | 0.4 |
| 20 | 57.32 | 57.00 | 114.32 | 42.75 | 43.07 | 85.82 | 0.3 |

However, we might consider practically perfect mixing to correspond to the situation where 50±0.5% of A and B are present in both channels. This corresponds to the situation where |A−B| in Table I equals 1, which is seen to occur after 16 stations have been traversed in this example.

The total transverse area required for the desired cross flow will depend upon the pressure difference (Δp) which, in turn, will depend upon the ratio of maximum to minimum axial area. For present purposes viscous losses will be ignored since they play the same role on each side of the mixer. Again, an example can be used to illustrate parameters of the mixing system. Assume the ratio of maximum to minimum axial area at each station; i.e., the enlargement-to-restriction ratio, is made 3:1. If the areas of f1 and f2 at station 0 are both equal to $A_o$, then the areas of f1 and f2 at station 1, designated $A_{1/1}$ and $A_{1/2}$, are:

$$A_{1/1}=1.5A_o \quad (1)$$

$$A_{1/2}=0.5A_o \quad (2)$$

By continuity, if the velocity at station 0 is $V_o$ in both channels, the velocities at station 1 are:

$$V_{1/1}=\tfrac{1}{3}V_o \quad (3)$$

$$V_{1/2}=2V_o \quad (4)$$

Assuming no loss between stations 0 and 1 and negligible change in elevation, then by Bernouilli's equation, the difference in pressure at station 1, designated $\Delta P_1$, will be $$\Delta p_1=\rho/2(V^2_{1/2}-V^2_{1/1}) \quad (5)$$

where $\rho$ is the mass density of the fluid.

The flow rate through the sharp edged transverse orifices can be represented by the following equation, for high Reynold's numbers:

$$Q_1' = 0.61\, A_1' \sqrt{\frac{2\Delta p_1}{\rho}} \quad (6)$$

where $A'_1$ is the total area of transverse perforations at station 1 (see e.g. "Unit Operations of Chemical Engineering" by McCabe & Smith, published by McGraw Hill). Substituting the expression for $\Delta p_1$ from (5) into (6) gives $$Q_1' = 0.61\, A_1' \sqrt{V^2_{1/2} - V^2_{1/1}} \quad (7)$$

For a cross-flow $Q'_1$ equal to $(\tfrac{1}{4})A_oV_o$, as in the example of Table I, we have $$\frac{A_oV_o}{4} = .61\,A_1'\,\frac{4\sqrt{2}}{3}\,V_o \tag{8}$$

or $$\frac{A_1'}{A_o} = 0.22 \tag{9}$$

Thus, for the desired cross-flow, the perforation area is 0.22 times the flow channel area at station 0. To compute the total perforation area at station 2, we first set forth the axial flow rates at station 1, taking into account the fluid gained or lost (i.e., $\frac{1}{4}$ $A_oV_o$) due to the cross-flow at station 1:

$$Q_{1f1} = \tfrac{3}{4}A_oV_o \tag{10}$$

$$Q_{1f2} = 5/4A_oV_o \tag{11}$$

Now, the velocities at station 2, can be computed by dividing by the areas at station 2:

$$V_{2f1} = \frac{3}{4}\,\frac{A_o}{A_{2f1}}\,V_o = \frac{3}{4}\,(2)V_o = \frac{3V_o}{2} \tag{12}$$

$$V_{2f2} = \frac{5}{4}\,\frac{A_o}{A_{2f2}}\,V_o = \frac{5}{4}\,(\frac{2}{3})V_o = \frac{5V_o}{6} \tag{13}$$

From (7), we then have, for the cross-flow:

$$Q_2' = 0.61\,A_2'\,V_o\sqrt{(\frac{3^2}{2}) - (\frac{5^2}{6})} = (0.61)A_2'V_o\sqrt{1.56} \tag{14}$$

For a 25% cross-flow, $Q'_2=(0.25)\,(1.25)A_oV_o$, so:

$$\frac{A_2'}{A_o} = \frac{(.25)\,(1.25)}{(.61)\sqrt{1.56}} = 0.41 \tag{15}$$

Similarly, to compute the total perforation area at station 3:

$$V_{3f1} = 1.06(\tfrac{3}{2})V_o = 0.71V_o \tag{16}$$

$$V_{3f2} = 0.94(2)V_o = 1.88V_o \tag{17}$$

$$Q'_3 = 0.61A'_3V_o\,\Lambda 3.01 \tag{18}$$

For a 25% cross-flow, $Q'_3=(0.25)\,(1.06)A_oV_o$, so:

$$\frac{A_3'}{A_o} = \frac{(.25)\,(1.06)}{(.61)\sqrt{3.01}} = 0.25$$

The perforation area at subsequent stations can be computed in the same manner.

Figure 4:
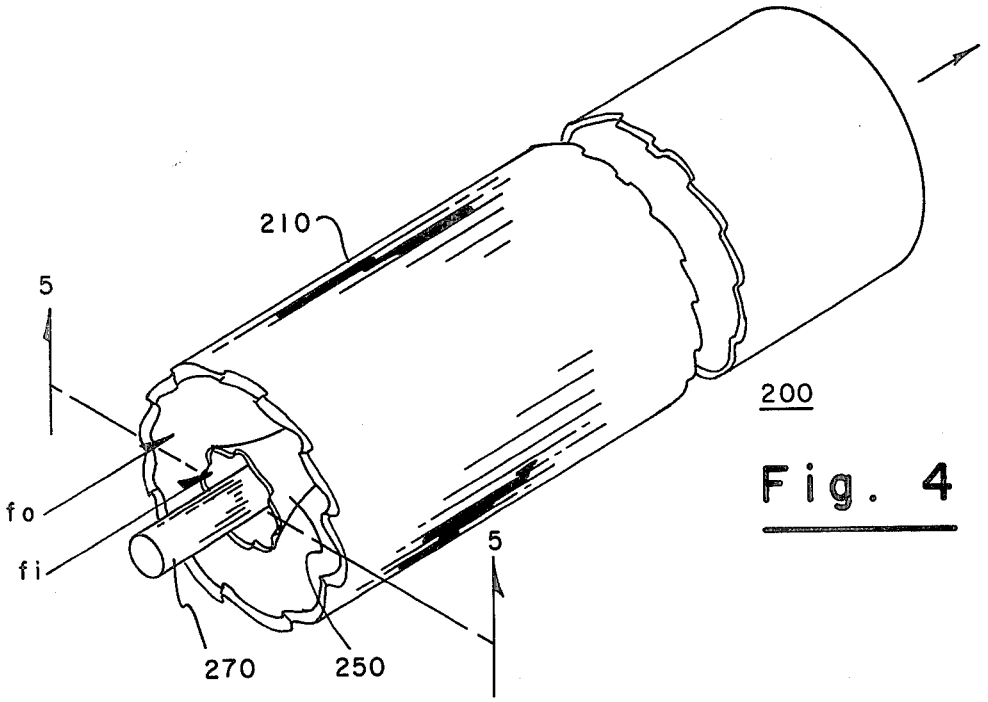
FIG. 4 is an elevational perspective partially broken away view of a static mixer in accordance with another embodiment of the invention.

Referring to FIG. 4, there is shown a motionless mixer 200 in accordance with another embodiment of the invention. An outer pipe 210 defines the outside wall of an outer flow channel fo. A central pipe 250 is in the form of an undulating annulus. The pipe 250 serves as a common wall element between outer flow channel fo and an inner flow channel fi; i.e., it is the inside wall of outer flow channel fo and it is the outside wall of inner flow channel fi. An inner pipe 270, through which no fluid need flow in this embodiment, serves as the inside wall of the inner flow channel fi. It will be understood, however, that the inner pipe 270 can, if desired, be utilized as an auxiliary flow pipe or to carry heating or cooling fluid. As in the previous embodiment, a plurality of openings or perforations are located at about the peaks and valleys of the common wall member; i.e., at about the maximum and minimum of the undulating annulus 250. The undulating annulus 250 may be held between pipes 210 and 270 by a spider mount (not shown) or other suitable mounting means.

Figure 7:
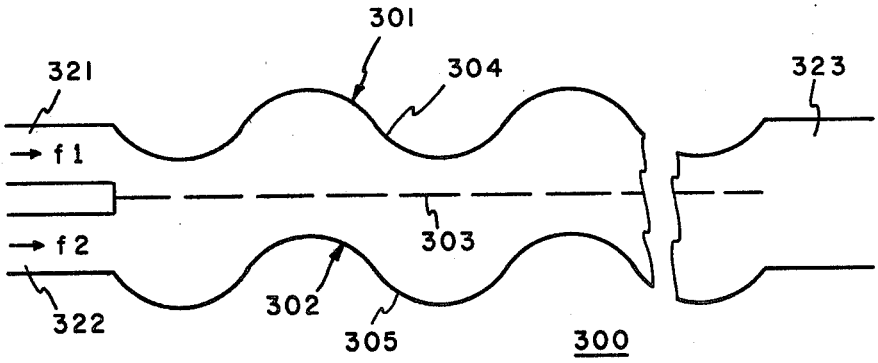
FIG. 7 is a cross-sectional view of a static mixer in accordance with another embodiment of the invention.

Referring to FIG. 7, there is shown a cross-sectional view of a motionless mixer 300 in accordance with still another embodiment of the invention. In the embodiment of FIG. 7, adjacent elongated undulating enclosures 301 and 302 form flow channels f1 and f2. A common wall member 303 is flat in this embodiment. The outer wall members 304 and 305 have undulating shapes and are arranged so that the undulations of the two flow channels are in opposing relationship; i.e., flow channel f1 is restricted when flow channel f2 is enlarged, and vice versa. The common wall element 303 has perforations at positions corresponding to the peaks and valleys of the undulations, as shown in FIG. 7. In operation, fluids to be mixed are injected into inlet pipes 321 and 322, which communicate with flow channels f1 and f2, respectively. Mixed fluids are received at outlet pipe 323. The opposing restrictions and enlargements of the flow channels cause mixing due to the venturi effect, as described in conjunction with previous embodiments.

Figure 8:
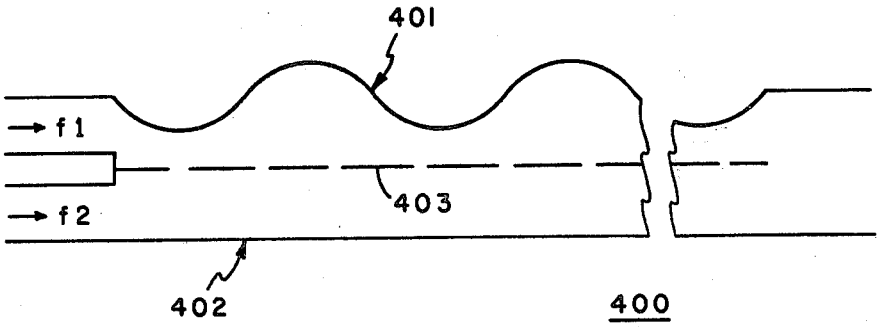
FIG. 8 is a cross-sectional view of a static mixer in accordance with still another embodiment of the invention.

FIG. 8 is similar to FIG. 7, but in this case a mixer 400 has an undulating enclosure 401 and a non-undulating enclosure 402. Thus, only flow channel f1 undulates while flow channel f2 does not. However, mixing occurs due to enlargements and restrictions of f1 and the resultant cross-flow through perforations in common wall element 403.

Figure 5:
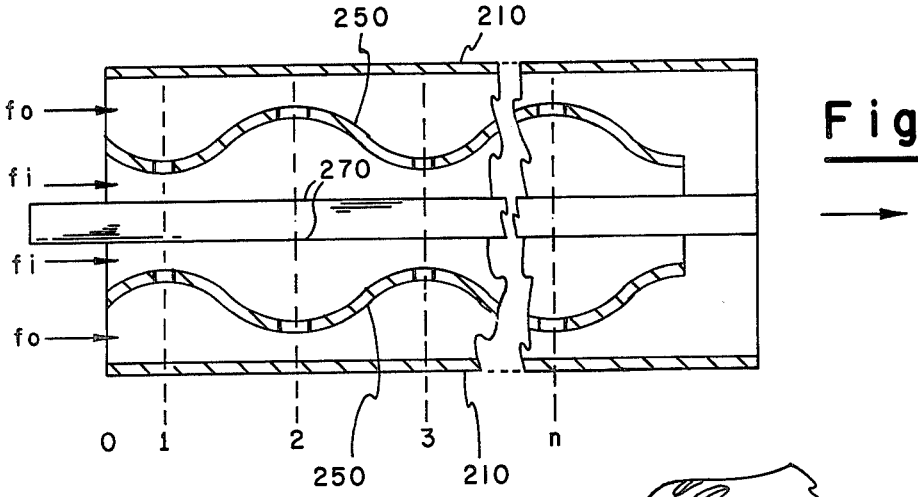
FIG. 5 is a cross-sectional view, taken through a section defined by arrows 5—5 of FIG. 4.
Figure 6:
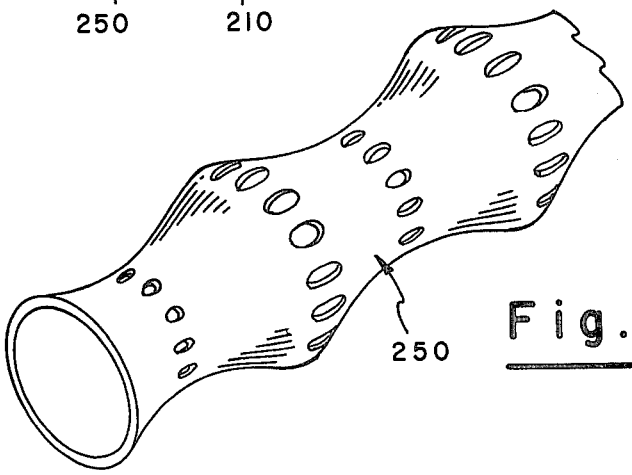
FIG. 6 shows the undulating annulus which serves as the common wall element of the FIG. 4 embodiment.

It will be understood that cylindrical versions of the FIG. 7 or FIG. 8 embodiments (analagous to the FIG. 5 embodiment) could be implemented using one or more undulating annuli (of the type illustrated in FIG. 6) with no perforations, and a conventional cylindrical pipe, with perforations in the cylindrical pipe at positions corresponding to peaks and valleys of the indulations.

There are various ways in which the apparatus of the present invention can be manufactured at relatively low cost. For example, with regard to the embodiment of FIG. 1, the undulating common wall element can be made as follows: The perforations are first punched in a flat metal sheet. The sheet is then passed through cammed rolling members adapted to form indentations in the sheet at the positions of the perforations; i.e., at the positions which are to become the peaks and valleys of the element. The sheet is then placed on a mandrel and buckled to obtain desired undulating shape. For the embodiments of FIGS. 7 or 8, the construction technique would be the same, except for the perforations. In the case of the embodiment of FIG. 4, the perforated sheet with indentations thereon is first roll welded in the manner in which tubing is conventionally formed, and then buckled from the ends to obtain the desired undulating annulus. The shapes described herein could alternatively be obtained using moldable materials in conjunction with known molding techniques.

What is claimed is:

1. Apparatus for mixing fluids, comprising:

a first elongated enclosure defining a first flow channel;

a second elongated enclosure adjacent said first enclosure and having a wall element in common therewith, said second enclosure having an undulating cross-section that defines a second flow channel which is an undulating flow channel;

said common wall element having openings therein at about longitudinal positions thereof corresponding to the peaks and valleys of the undulations of said second flow channel.

2. Apparatus as defined by claim 1 wherein the undulations of said second enclosure are defined by undulations of a wall element thereof other than said common wall element.

3. Apparatus as defined by claim 1 wherein said first enclosure has an undulating cross-section defining said first undulating flow channel, and wherein the undulations of said first and second flow channels are in opposing relationship so that one of said flow channels enlarges and restricts in opposing relationship to restriction and enlargement, respectively, in the other flow channel.

4. Apparatus as defined by claim 3 wherein the undulations of said first and second enclosures are defined by undulations of said common wall element.

5. Apparatus as defined by claim 4 wherein each plurality of perforations is disposed in a row substantially normal to the direction of flow.

6. Apparatus as defined by claim 4 wherein the size and number of said perforations at positions corresponding to each peak and valley are selected in accordance with the expected pressure differential at each said position.

7. Apparatus as defined by claim 6 wherein said openings comprise a plurality of perforations at each of the peaks and valleys of said undulations.

8. Apparatus as defined by claim 7 wherein the enlargement-to-restriction ratio of said channels is about three to one.

9. Apparatus as defined in claim 7 further comprising first and second inlet means for applying said fluids to be mixed to said pair of flow channels, and outlet means for receiving mixed fluids from both flow channels.

10. Apparatus as defined by claim 7 wherein said common wall element comprises an undulating sheet separating side-by-side flow channels.

11. Apparatus as defined by claim 7 wherein said common wall element comprises an undulating annulus separating concentric flow channels.

12. Apparatus as defined by claim 6 wherein the size of the openings at each peak and valley are selected in accordance with the expected pressure differential at said peak or valley.

13. Apparatus as defined by claim 12 further comprising first and second inlet means for applying said fluids to be mixed to said pair of flow channels, and outlet means for receiving mixed fluids from both flow channels.

14. Apparatus as defined by claim 12 wherein said common wall element comprises an undulating sheet separating side-by-side flow channels.

15. Apparatus as defined by claim 12 wherein said common wall element comprises an undulating annulus separating concentric flow channels.

16. Apparatus as defined by claim 15 wherein said openings comprise a ring of perforations at each of the peaks and valleys of said undulations.

17. Apparatus as defined by claim 15 wherein the size of the openings at each peak and valley are selected in accordance with the expected pressure differential at said peak or valley.

18. Apparatus as defined by claim 15 wherein the enlargement-to-restriction ratio of said channels is about three to one.

19. Apparatus as defined by claim 6 wherein the enlargement-to-restriction ratio of said channels is about three to one.

20. Apparatus as defined by claim 6 further comprising first and second inlet means for applying said fluids to be mixed to said pair of flow channels, and outlet means for receiving mixed fluids from both flow channels.

21. Apparatus as defined by claim 6 wherein said common wall element comprises an undulating sheet separating side-by-side flow channels.

22. Apparatus as defined by claim 6 wherein said common wall element comprises an undulating annulus separating concentric flow channels.

23. Apparatus as defined by claim 3 wherein the undulations of said first and second enclosures are defined by undulations of wall elements of said enclosures other than said common wall element.

24. Apparatus as defined by claim 3 wherein said openings comprise a plurality of perforations at each of the positions corresponding to peaks and valleys of said undulations.

25. Apparatus as defined by claim 3 wherein the size of the openings at positions corresponding to each peak and valley are selected in accordance with the expected pressure differential at each said position.

26. Apparatus as defined by claim 3 further comprising first and second inlet means for applying said fluids to be mixed to said first and second flow channels, respectively, and outlet means for receiving mixed fluids from both flow channels.

27. Apparatus as defined by claim 26 wherein the perforations at each peak and valley are disposed in a row substantially normal to the direction of flow.

28. Apparatus as defined by claim 26 wherein the size and number of said perforations at each peak and valley are selected in accordance with the expected pressure differential at said peak or valley.

29. Apparatus as defined by claim 26 wherein the enlargement-to-restriction ratio of said channels is about three to one.

30. Apparatus as defined by claim 29 wherein said common wall element comprises an undulating sheet separating side-by-side flow channels.

31. Apparatus as defined by claim 29 wherein said common wall element comprises an undulating annulus separating concentric flow channels.

32. Apparatus as defined by claim 31 wherein the perforations at eack peak and valley are disposed in a ring substantially normal to the direction of flow.

33. Apparatus as defined by claim 32 wherein the enlargement-to-restriction ratio of said channels is about three to one.

34. Apparatus as defined by claim 31 wherein the size and number of said perforations at each peak and valley are selected in accordance with the expected pressure differential at said peak or valley.

35. Apparatus as defined by claim 26 further comprising first and second inlet means for applying said fluids to be mixed to said pair of flow channels, and outlet means for receiving mixed fluids from both flow channels.

36. Apparatus for mixing fluids, comprising a pair of flow channels for respectively receiving the fluids to be mixed at respective ends thereof, said flow channels having at least one common wall element therebetween, said common wall having an undulating shape which alternately enlarges and restricts one of said channels while simultaneously alternately restricting and enlarging the other of said channels in an opposing relationship; said common wall having openings therein at about the peaks and valleys of the undulations.

37. Apparatus for mixing fluids, comprising:

inner and outer substantially concentric spaced pipes;

a central pipe in the form of an undulating annulus substantially concentric with said inner and outer pipes and mounted therebetween in spaced relation to both said pipes, said central pipe having openings therein at about the peaks and valleys of its undulations;

a first inlet means for applying a first fluid to be mixed to an outer flow channel defined by the region between said central and outer pipes;

a second inlet means for applying a second fluid to be mixed to an inner flow channel defined by the region between said central and inner pipes; and outlet means for receiving mixed fluids from both flow channels.

38. Apparatus as defined by claim 37 wherein the enlargement-to-restriction ratio of said channels is about three to one.

* * * * *